US010161421B2

(12) United States Patent
Oklejas, Jr.

(10) Patent No.: US 10,161,421 B2
(45) Date of Patent: Dec. 25, 2018

(54) METHOD AND SYSTEM FOR INJECTING A PROCESS FLUID USING A HIGH PRESSURE DRIVE FLUID

(71) Applicant: Eli Oklejas, Jr., Newport, MI (US)

(72) Inventor: Eli Oklejas, Jr., Newport, MI (US)

( * ) Notice: Subject to any disclaimer, the term of this patent is extended or adjusted under 35 U.S.C. 154(b) by 401 days.

(21) Appl. No.: 15/013,186

(22) Filed: Feb. 2, 2016

(65) Prior Publication Data

US 2016/0222985 A1 Aug. 4, 2016

Related U.S. Application Data

(60) Provisional application No. 62/261,936, filed on Dec. 2, 2015, provisional application No. 62/111,270, filed on Feb. 3, 2015.

(51) Int. Cl.

| | |
|---|---|
| ***F04F 1/06*** | (2006.01) |
| ***F04B 23/06*** | (2006.01) |
| ***F04B 15/00*** | (2006.01) |
| ***F04B 19/22*** | (2006.01) |
| ***F04B 53/14*** | (2006.01) |
| ***F04B 53/16*** | (2006.01) |

(Continued)

(52) U.S. Cl.

CPC ..... *F04F 1/06* (2013.01); *F04B 9/08* (2013.01); *F04B 15/00* (2013.01); *F04B 15/02* (2013.01); *F04B 19/22* (2013.01); *F04B 23/06* (2013.01); *F04B 53/10* (2013.01); *F04B 53/14* (2013.01); *F04B 53/16* (2013.01)

(58) Field of Classification Search

CPC ..... F04F 1/06; F04F 15/00

USPC ..... 166/90.1

See application file for complete search history.

(56) References Cited

U.S. PATENT DOCUMENTS 3,326,135 A 6/1967 Smith
3,907,462 A * 9/1975 Kroeger ..... F04F 1/06 417/102

(Continued)

FOREIGN PATENT DOCUMENTS

CA 2712522 A1 2/2012
DE 4022379 A1 1/1991

(Continued)

OTHER PUBLICATIONS

International Search Report for PCT/US2017/060559 dated Feb. 14, 2018, 7 pages.

(Continued)

*Primary Examiner* — Taras P Bemko

(74) *Attorney, Agent, or Firm* — Harness, Dickey & Pierce, P.L.C.

(57) ABSTRACT

A system and method of operating the same includes a first fluid cylinder having a first process fluid end and a first drive fluid end. The first cylinder comprising a first process fluid inlet port and a first process fluid outlet port disposed at the first process fluid end of the first fluid cylinder and first drive fluid inlet port and a first drive fluid outlet port disposed at the first fluid end of the first fluid cylinder. The first fluid cylinder is oriented vertically. A first liquid fluid interface is disposed between the first process fluid end and the first drive fluid end to divide the first fluid cylinder into a first process fluid portion and a first drive fluid portion. A first pump pumps drive fluid to the drive fluid portion to drive the fluid interface to pressurize the process fluid.

7 Claims, 15 Drawing Sheets

(51) Int. Cl.

| | |
|---|---|
| ***F04B 53/10*** | (2006.01) |
| ***F04B 9/08*** | (2006.01) |
| ***F04B 15/02*** | (2006.01) |

(56) References Cited

U.S. PATENT DOCUMENTS

| | | | |
|---|---|---|---|
| 4,347,223 | A | 8/1982 | Kitaoka et al. |
| 4,536,131 | A | 8/1985 | Saito et al. |
| 5,533,868 | A | 7/1996 | Fassbender |
| 6,540,487 | B2 | 4/2003 | Polizos et al. |
| 7,201,557 | B2 | 4/2007 | Stover |
| 7,871,522 | B2 | 1/2011 | Stover et al. |
| RE42,432 | E | 6/2011 | Stover |
| 7,997,853 | B2 | 8/2011 | Pique et al. |
| 8,075,281 | B2 | 12/2011 | Martin et al. |
| 8,579,603 | B2 | 11/2013 | Oklejas et al. |
| 8,742,604 | B2 | 6/2014 | Dyer et al. |
| 8,834,028 | B2 | 9/2014 | Winkler et al. |
| 9,440,895 | B2 | 9/2016 | Arluck et al. |
| 9,604,889 | B2 | 3/2017 | Arluck et al. |
| 9,683,574 | B2 | 6/2017 | Winkler et al. |
| 9,695,795 | B2 | 7/2017 | Martin et al. |
| 9,739,128 | B2 | 8/2017 | Ghasripoor et al. |
| 9,759,054 | B2 | 9/2017 | Gay et al. |
| 9,764,272 | B2 | 9/2017 | Martin et al. |
| 9,835,018 | B2 | 12/2017 | Krish et al. |
| 9,885,372 | B2 | 2/2018 | Arluck et al. |
| 9,920,774 | B2 | 3/2018 | Ghasripoor et al. |
| 9,945,210 | B2 | 4/2018 | Theodossiou |
| 9,945,216 | B2 | 4/2018 | Ghasripoor et al. |
| 9,970,281 | B2 | 5/2018 | Ghasripoor et al. |
| 9,975,789 | B2 | 5/2018 | Ghasripoor et al. |
| 9,976,573 | B2 | 5/2018 | Martin et al. |
| 2014/0091573 | A1 | 4/2014 | Berbari |
| 2014/0093407 | A1 | 4/2014 | Calkins et al. |
| 2014/0128655 | A1 | 5/2014 | Arluck et al. |
| 2014/0128656 | A1 | 5/2014 | Arluck et al. |
| 2014/0260357 | A1 | 9/2014 | Marte |
| 2014/0260379 | A1 | 9/2014 | Marte |
| 2014/0260380 | A1 | 9/2014 | Marte |
| 2014/0260381 | A1 | 9/2014 | Marte et al. |
| 2014/0263682 | A1 | 9/2014 | Marte |
| 2015/0043845 | A1 | 2/2015 | Winkler et al. |
| 2015/0068975 | A1 | 3/2015 | Krish |
| 2015/0096739 | A1 | 4/2015 | Ghasripoor et al. |
| 2015/0118131 | A1 | 4/2015 | Martin et al. |
| 2015/0184492 | A1 | 7/2015 | Ghasripoor et al. |
| 2015/0184502 | A1 | 7/2015 | Krish et al. |
| 2015/0184540 | A1 | 7/2015 | Winkler et al. |
| 2015/0184678 | A1 | 7/2015 | Arluck et al. |
| 2015/0198338 | A1 | 7/2015 | Marte |
| 2015/0211384 | A1 | 7/2015 | Krish et al. |
| 2015/0275844 | A1 | 10/2015 | Winkler et al. |
| 2015/0292310 | A1 | 10/2015 | Ghasripoor et al. |
| 2016/0023539 | A1 | 1/2016 | Johnson, Sr. |
| 2016/0032691 | A1 | 2/2016 | Richter et al. |
| 2016/0032702 | A1 | 2/2016 | Gay et al. |
| 2016/0039054 | A1 | 2/2016 | Ghasripoor et al. |
| 2016/0040510 | A1 | 2/2016 | Martin et al. |
| 2016/0040511 | A1 | 2/2016 | Theodossiou |
| 2016/0062370 | A1 | 3/2016 | Gaines-Germain et al. |
| 2016/0138649 | A1 | 5/2016 | Anderson et al. |
| 2016/0146229 | A1 | 5/2016 | Martin et al. |
| 2016/0160849 | A1 | 6/2016 | Gains-Germain et al. |
| 2016/0160881 | A1 | 6/2016 | Anderson et al. |
| 2016/0160882 | A1 | 6/2016 | Morphew |
| 2016/0160887 | A1 | 6/2016 | Anderson |
| 2016/0160888 | A1 | 6/2016 | Morphew |
| 2016/0160889 | A1 | 6/2016 | Hoffman et al. |
| 2016/0160890 | A1 | 6/2016 | Anderson |
| 2016/0160917 | A1 | 6/2016 | Deshpande |
| 2016/0222985 | A1 | 8/2016 | Oklejas, Jr. |
| 2016/0281487 | A1 | 9/2016 | Ghasripoor et al. |
| 2016/0312140 | A1 | 10/2016 | Krish et al. |
| 2017/0051762 | A1 | 2/2017 | Ghasripoor et al. |
| 2017/0130743 | A1 | 5/2017 | Anderson |
| 2017/0267549 | A1 | 9/2017 | Ghasripoor et al. |
| 2017/0306986 | A1 | 10/2017 | McLean, Jr. et al. |
| 2017/0306987 | A1 | 10/2017 | Theodossiou |
| 2017/0335668 | A1 | 11/2017 | Ghasripoor et al. |
| 2017/0350428 | A1 | 12/2017 | Martin et al. |
| 2018/0087364 | A1 | 3/2018 | Krish et al. |
| 2018/0094648 | A1 | 4/2018 | Hoffman et al. |
| 2018/0149005 | A1 | 5/2018 | Baird et al. |

FOREIGN PATENT DOCUMENTS

| | | | |
|---|---|---|---|
| GB | 854565 | A | 11/1960 |
| GB | 1420424 | A | 1/1976 |
| JP | S6419185 | A | 1/1989 |
| JP | 3395122 | B2 | 4/2003 |

OTHER PUBLICATIONS

International Search Report regarding Application No. PCT/US2016/016366 dated Aug. 1, 2016, ISA—Rijswijk, NL.

* cited by examiner

| CV28 | CV36 | CV30 | CV38 | TV68 | TV70 | PS76 | PS78 | PS84 | PS88 | Comments |
|---|---|---|---|---|---|---|---|---|---|---|
| C | O | O | C | A | B | No | No | No | No | Fig. 2 – Cyln 12 pumping, Cyln 14 filling |
| C | C | C | C | --- | --- | Yes | No | No | Yes | Fig. 3 – TV68 and TV70 changing states |
| O | C | C | O | B | A | No | No | No | No | Fig. 4 – Cyln 12 filling, Cyln 14 pumping |
| C | C | C | C | --- | --- | No | Yes | Yes | No | Fig. 5 – TV68 and TV70 changing states |

FIG. 6
Prior Art

| CV28 | CV36 | CV30 | CV38 | TV68 | TV70 | FM122 | FM214 | Comments |
|---|---|---|---|---|---|---|---|---|
| C | O | O | C | A | B | No | No | Cyln 12 pumping, Cyln 14 filling |
| C | C | C | C | --- | --- | Lim | No | TV70 and TV68 changing states |
| O | C | O | C | B | A | No | No | Cyln 12 filling, Cyln 14 pumping |
| C | C | C | C | --- | --- | No | Lim | TV70 and TV68 changing states |

FIG. 14

METHOD AND SYSTEM FOR INJECTING A PROCESS FLUID USING A HIGH PRESSURE DRIVE FLUID

RELATED APPLICATION

This application is a non-provisional application of provisional application 62/111,270, filed Feb. 3, 2015 and 62/261,936, filed Dec. 2, 2015, the disclosures of which are incorporated by reference herein.

TECHNICAL FIELD

The present disclosure relates generally to injecting process fluids into a process and, more specifically to injecting a process fluid such as a slurry into a process stream using a drive fluid.

BACKGROUND

The statements in this section merely provide background information related to the present disclosure and may not constitute prior art.

Pumping of process fluids are used in many industries Process fluids may be pumped with a various types of pumps that are driven by a drive fluid. A slurry is one type of process fluid. Slurries are typically abrasive in nature. Slurry pumps are used in many industries to provide the slurry into the process. Sand injection for hydraulic fracturing (fracking), high pressure coal slurry pipelines, mining, mineral processing, aggregate processing, and power generation all use slurry pumps. All of these industries are extremely cost competitive. A slurry pump must be reliable and durable to reduce the amount of down time for the various processes.

Slurry pumps are subject to severe wear because of the abrasive nature of the slurry. Typically, slurry pumps display poor reliability, and therefore must be repaired or replaced often. This increases the overall process costs. It is desirable to reduce the overall process costs and increase the reliability of a slurry pump.

Direct acting liquid driven pumps have been developed, in which a high pressure drive fluid is used to pressurize a process fluid by direct contact, or separated by a membrane or piston. The known system described below is used for a slurry as the process fluid.

Referring now to FIG. 1, one example of a known slurry injection system 10 is shown. The slurry injection system 10 includes a first cylinder 12 and a second cylinder 14. The first cylinder 12 includes a slurry or process fluid inlet port 16 and a slurry or process fluid outlet port 18. The second cylinder 14 includes a slurry or process fluid inlet port 20 and a slurry or process fluid outlet port 22. The process fluid inlet ports 16, 20 are in fluid communication with a low pressure pump 24 and a process fluid tank 26. Low pressure fluid is drawn from the process fluid tank 26 by the low pressure pump 24. Process fluid is communicated through the check valves (CVs) 28, 30 in the respective process fluid inlet ports 16, 20. The check valves 28, 30 operate to allow the low pressure process fluid or slurry to be drawn into the respective cylinders 12, 14 when the pressure within the process fluid portions 32, 34 of each cylinder 12, 14, is below the check valve set pressure and prevent the pressurized process fluid from leaving the cylinders 12, 14.

Pressurized fluid from each cylinder 12, 14 is communicated through the slurry or process fluid outlet ports 18, 22 through respective check valves 36, 38. The check valves 36, 38 open when the pressure within the process portions 32, 34 is greater than the check valve set pressure. High pressure process fluid is communicated from the process fluid outlet ports 18, 22 to a high pressure process 40. The high pressure process 40 may be one of the various types of processes described above.

Each cylinder 12, 14 includes a respective piston 50, 52. The piston 50, 52 divides the respective cylinders 12, 14 into a process fluid portion 32, 34 and a drive fluid portion 54, 56.

The cylinder 12 includes a drive fluid inlet port 58 and a drive fluid outlet port 60. The cylinder 14 includes a drive fluid inlet port 62 and a drive fluid outlet port 64. Fluid is communicated from a high pressure drive fluid reservoir 66 through a three-way valve 68 to the drive inlet port 58, which is in fluid communication with the drive portion 54. High pressure drive fluid is also communicated from the three-way valve 68 to the drive fluid inlet port 62, which is in fluid communication with the drive fluid portion 56.

The drive fluid outlet ports 60, 64 are in communication with a three-way valve 70, which selectively communicates low pressure drive fluid to a low pressure reservoir 72.

Cylinder 12 has a first end 74 which corresponds to a process fluid end, and includes a proximity sensor 76. The cylinder 12 has a second end that corresponds to a drive fluid end 78. The drive fluid end 78 has a proximity sensor 80. The process fluid end 74 also includes the process fluid inlet port 16 and the process fluid outlet port 18. The drive fluid end 78 includes the drive fluid inlet port 58 and the drive fluid outlet port 60.

The cylinder 14 includes a first end 82 that corresponds to a process fluid or slurry end and includes a proximity sensor 84. The cylinder 14 includes a second end 86 that corresponds to drive fluid end. The second end 86 includes a proximity sensor 88. The proximity sensors 76, 80, 84 and 88 detect when the respective pistons 50, 52 are at the respective ends of the cylinders 12, 14.

In operation, high pressure fluid from the high pressure fluid reservoir 66 is selectively coupled to either the drive fluid portion 54 or the drive fluid portion 56, but not both. The pistons 50, 52 are preferably 180° out of phase. That is, when the piston 50 is moving left, the piston 52 is moving right, and vice versa. In FIG. 1, high pressure fluid is being communicated into the drive portion 54 so that the piston 50 is moving leftward and pressurizing the slurry or process fluid in the process portion 32. As a result, high pressure process fluid is communicated through the port 18 to the high pressure process 40. Concurrently, low pressure process fluid is being drawn into the process fluid end 34 of the cylinder 14 through the process fluid inlet port 20.

Referring now to FIGS. 2-5, an entire pumping cycle is illustrated. Specifically, FIG. 2 is the start of a pumping cycle. The piston 50 of cylinder 12 is moving toward the check valves 28 and 36. High pressure process fluid is driven toward the high pressure process 40. The piston 50 is driven by the drive fluid being communicated from the high pressure fluid reservoir 66. Piston 52 is moving toward the drive fluid end 86. That is, low pressure process fluid is communicated into the process portion 34 through the check valve 30 while the three-way valve 68 is closed relative to the fluid cylinder 14. The three-way valve 70 is opened so that drive fluid is communicated to the low pressure reservoir 72 therethrough. For cylinder 12, the check valve 68 is opened so that drive fluid is communicated through the check valve 68 into the drive fluid portion 54. The check valve 68 is closed relative to cylinder 14. Check valve 70 is closed relative to cylinder 12, but opened relative to cylinder 14.

Referring now specifically to FIG. 3, both piston 50 and piston 52 have reached respective ends of their cycles.

Proximity switch 76 generates a proximity signal to halt the progress of piston 50 relative to the fluid cylinder 12. Proximity switch 88 halts the progress of piston 52 toward the drive fluid end 86 of the fluid cylinder 14. At this point, the operation of the three-way valves 68 and 70 are changed. That is, the three-way valve 68 is now switched to provide drive fluid to the drive fluid portion of the fluid cylinder 14 while the three-way valve 70 is switched to remove drive fluid from the drive portion 54 of the fluid cylinder 12. Thus, drive fluid is communicated from the high pressure fluid reservoir 66 to the fluid cylinder 14 through the three-way valve 68. Drive fluid from the fluid cylinder 12 is communicated through the three-way valve 70 to the low pressure reservoir 72. The signal from the proximity sensor 76 is used to switch the connection of low pressure fluid from fluid cylinder 12 to fluid cylinder 14. That is, low pressure fluid from the process fluid tank 26 is communicated through the pump 24 to the process fluid inlet port 16 through check valve 28. Process fluid is thus discontinued from being communicated into the slurry inlet port 20.

Referring now to FIG. 4, the pistons 50, 52 are illustrated in mid-stroke. The piston 50 is travelling toward the drive end, while piston 52 is travelling toward the process fluid end. Fluid cylinder 12 is filling with low pressure process fluid while fluid cylinder 14 is pumping high pressure process fluid to the high pressure process 40 under the control of the high pressure drive fluid being communicated through the drive inlet port 62. Drive fluid is communicated to the low pressure reservoir 72 through the drive outlet port 60.

Referring now to FIG. 5, the proximity switch 80 and the proximity switch 84 are reached, and thus the inlet and outlet port configurations are changed. That is, when the proximity switches 80 and 84 have been reached, the three-way valves 68 and 70 and the use of the inlet ports, 16 and 20 are changed to operate in the manner set forth in FIG. 2 above. This begins a new process cycle carrying forward with the examples of FIGS. 2-4.

The chart illustrated in FIG. 6 provides a summary of FIGS. 2-5. In the first row corresponding to FIG. 2, the check valve 28 is closed, while check valves 36 and 30 are open. Check valve 38 is closed. Three-way valve 68 is communicating fluid to cylinder A, while three-way valve 70 is communicating fluid from fluid cylinder 14. None of the proximity sensors has been reached. The second row of FIG. 6 corresponds to FIG. 3, in which all three of the check valves are closed. The three-way valves are in a switching state, and proximity sensors 76 and 88 have been reached.

The third row of FIG. 6 corresponds to the operation of FIG. 4, in which check valves 28 and 38 are open, while check valves 36 and 30 are closed. Three-way valve 68 is communicated fluid to fluid cylinder 14. Three-way valve 70 is removing fluid from fluid cylinder 12. None of the proximity switches has been reached.

The third row of FIG. 6 corresponds to FIG. 5, in which all three check valves are closed. The three-way valves are in a switching state, while proximity switches 76 and 84 have been reached.

There are several technological limitations set forth in the configuration shown in FIGS. 1-5 set forth above. For example, the proximity switches may not be reached at the same time by the pistons 50 and 52. This may cause the three-way valves to be switched before the other cylinder is done processing. This may result in an interruption of process fluid flow.

SUMMARY

The present disclosure is directed to a method and system that allows abrasive slurries to be injected into a very high pressure process stream with minimal wear. The system provides high reliability due to the reduced amount of wear.

In one aspect of the disclosure, a system includes a first fluid cylinder having a first process fluid end and a first drive fluid end. The first cylinder comprising a first process fluid inlet port and a first process fluid outlet port disposed at the first process fluid end of the first fluid cylinder and first drive fluid inlet port and a first drive fluid outlet port disposed at the first fluid end of the first fluid cylinder. The first fluid cylinder is oriented vertically. A first liquid fluid interface is disposed between the first process fluid end and the first drive fluid end to divide the first fluid cylinder into a first process fluid portion and a first drive fluid portion. A first pump pumps drive fluid to the drive fluid portion to drive the fluid interface to pressurize the process fluid.

In another aspect of the disclosure, a method includes communicating drive fluid into a drive fluid portion of a fluid cylinder having a first end and a second end. The fluid cylinder comprises a process fluid inlet port and a process fluid outlet port disposed at the first end and drive fluid inlet port and a drive fluid outlet port disposed at a second end of the cylinder. The method further includes moving a fluid interface to pressurize process fluid in response to communicating drive fluid to the drive portion, forcing pressurized process fluid from a process fluid outlet port, communicating drive fluid past a valve in the process fluid outlet port, and closing the valve within the drive fluid.

In yet another aspect of the disclosure, a system includes a fluid cylinder having a first end and a second end. The fluid cylinder comprises a process fluid inlet port and a process fluid outlet port disposed at the first end and drive fluid inlet port and a drive fluid outlet port disposed at the second end. A piston is disposed between the first end and the second end to divide the cylinder into a process fluid portion and a drive fluid portion. The piston has a first face within the process fluid portion and a second face within the drive fluid portion. The piston comprises a piston port therethrough. The piston port has a check valve for selectively passing drive fluid from the drive fluid portion therethrough. The first face has a circumferential clearance adjacent to an interior wall of the fluid cylinder. The piston comprises a plurality of channels fluidically coupling the piston port and the circumferential clearance so that drive fluid from the drive fluid portion displaces process fluid from the circumferential clearance.

In a further aspect of the disclosure, a method includes communicating drive fluid into a drive fluid portion of a fluid cylinder having a first end and a second end. The fluid cylinder has a process fluid inlet port and a process fluid outlet port disposed at the first end and drive fluid inlet port and a drive fluid outlet port disposed at a second end of the cylinder. The method further includes moving a piston to pressurize process fluid in response to communicating drive fluid to the drive portion. The piston comprises a piston port therethrough. The method further includes selectively communicating drive fluid from the drive fluid portion though a check valve disposed within the piston port, communicating drive fluid through channels within the piston to a circumferential channel disposed within a process fluid face of the piston and displacing process fluid from the circumferential channel as the piston moves toward the first end.

In another aspect of the disclosure, a method includes communicating drive fluid into a drive fluid portion of a fluid cylinder having a first end and a second end. The fluid cylinder includes a process fluid inlet port and a process fluid outlet port disposed at the first end and drive fluid inlet port and a drive fluid outlet port disposed at a second end of the cylinder. The method also includes moving a piston to pressurize process fluid in response to communicating drive fluid to the drive portion, communicating drive fluid through an axial groove in an interior wall of the fluid cylinder adjacent to the first end, communicating drive fluid through the axial groove when the piston when the piston reaches the axial groove and stopping movement of the piston toward the first end.

In another aspect of the disclosure, a system includes a first fluid cylinder having a first piston dividing the first fluid cylinder into a first process portion and a first drive fluid portion. The first drive fluid portion includes a first drive fluid inlet port and a first drive fluid outlet port. The system further includes a second fluid cylinder having a second piston dividing the second fluid cylinder into a second process portion and a second drive fluid portion. The second drive fluid portion includes a second drive fluid inlet port and a second drive fluid outlet port. A first three way valve is coupled to a high pressure drive fluid source and the first drive fluid inlet port and the second drive fluid inlet port. The first three way valve has a first state coupling the high pressure drive fluid source to the first drive fluid inlet port, a second state coupling the high pressure drive fluid source to the second drive fluid inlet port and a first dead zone state not coupling the high pressure drive fluid source to either the first drive fluid inlet port or the second drive fluid inlet port. The system also includes a second three way valve coupled to a low pressure drive fluid reservoir and the first drive fluid outlet port and the second drive fluid outlet port. The second three way valve has a first state coupling the first drive fluid outlet port to the low pressure drive fluid reservoir, a second state coupling second drive fluid outlet port to the low pressure drive fluid reservoir and a second dead zone state not coupling the low pressure drive fluid reservoir to either the first drive fluid outlet port or the second drive fluid outlet port. A first valve is coupled between the first three way valve and a high pressure drive fluid source. A second valve is coupled between the drive fluid outlet and the second three way valve. A third valve is coupled between the three way valve and second drive fluid inlet port. A fourth valve is coupled between second three way valve and the drive fluid reservoir. A first proximity sensor or a flow meter generates a first proximity signal corresponding to a first proximity of the first piston relative to the first drive fluid inlet port. A second proximity sensor or the flow meter generates a second proximity signal corresponding to a proximity of the second piston relative to the second drive fluid inlet port. A controller is coupled to the first valve, the second valve, the third valve and the fourth valve. The controller switches the first three way valve to the first dead zone state in response to the first proximity signal. The controller gradually opens the first valve or said second valve when the first three way valve is in the first dead zone state and gradually opens the third valve or the fourth valve when the second three way valve is in the second dead zone state.

In another aspect of the disclosure, a method includes operating a three way valve having a first state communicating fluid therethrough, a second state communicating fluid therethrough and third state not communicating fluid therethrough. The method further includes communicating drive fluid to a fluid cylinder through incoming piping in the first state. The method further includes detecting a piston proximity to a drive fluid end of a drive fluid portion of fluid cylinder and generating a proximity signal, and in response to the proximity signal, switching the three way valve to the third state. The method further includes opening a bypass valve to equalize a first pressure in a drive portion of the fluid cylinder to correspond to a second pressure in the incoming piping or outgoing piping. Also after opening the bypass valve, switching the three way valve to the second state is performed.

In another aspect of the disclosure, a system includes a first fluid cylinder having a maximum operating pressure and a second fluid cylinder disposed around the first fluid cylinder forming an annular space therebetween. The second fluid cylinder includes a first end and a second end. A fixed mount is coupled to the second fluid cylinder disposed near the first end. A roller mount is coupled to the second fluid cylinder disposed near the second end. The annular space is at a pressure equal to or greater than the maximum operating pressure.

In another aspect of the disclosure, a method includes communicating drive fluid to an annular space between a first fluid cylinder having a maximum drive fluid operating pressure and a second fluid cylinder disposed around the first fluid cylinder to form the annular space therebetween, communicating drive fluid to the annular space, maintaining about the maximum drive fluid operating pressure within the annular space while moving a piston toward a first end of the first fluid cylinder, fixedly mounting a second end of the second fluid cylinder, roller mounting the first end of the second fluid cylinder to allow the second fluid cylinder to move relative to a roller.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

FIG. 6 is a state chart corresponding to the states of the check valves, three-way valves, and position sensors of FIGS. 2-5.

FIG. 14 is a state table for the check valves, three-way valves, and flow meters of FIG. 13.

DETAILED DESCRIPTION

Figure 1:
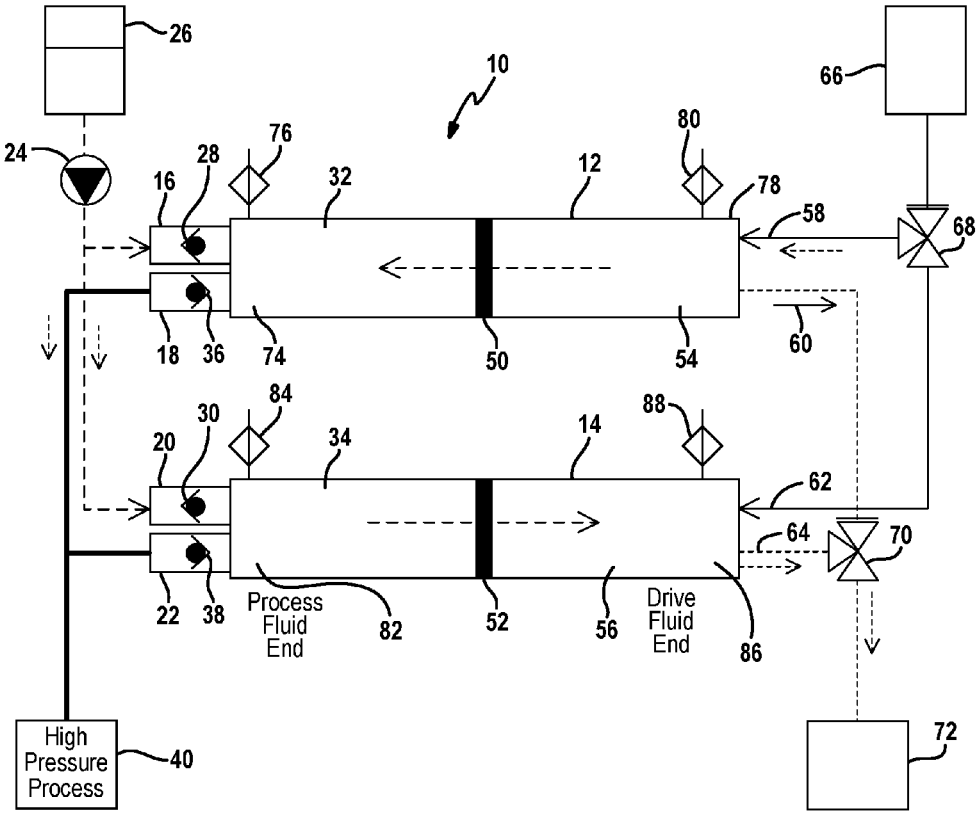
FIG. 1 Prior Art
FIG. 1 is a schematic view of a slurry injection system.
Figure 2:
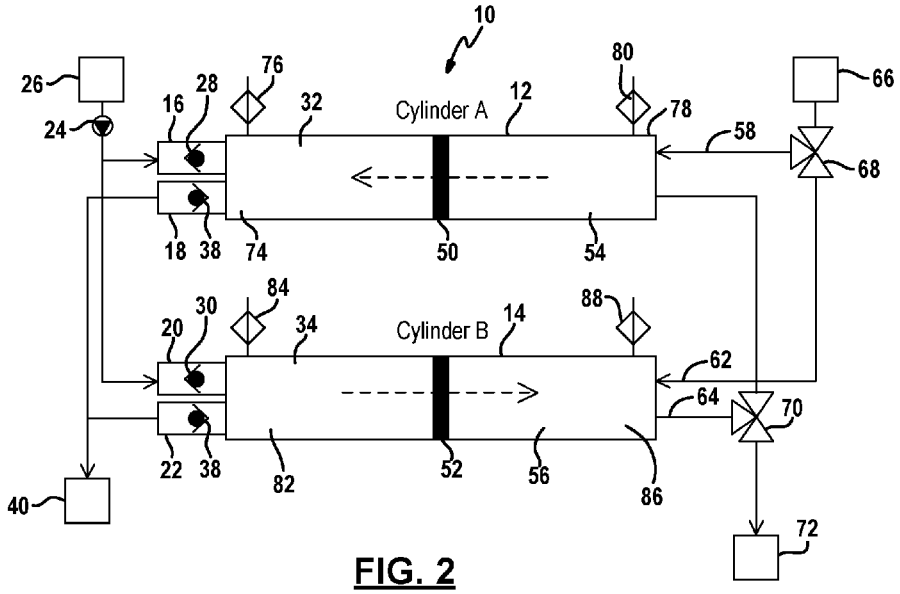
FIG. 2 Prior Art
FIG. 2 is a schematic view of a slurry injection system at a beginning state.
Figure 3:
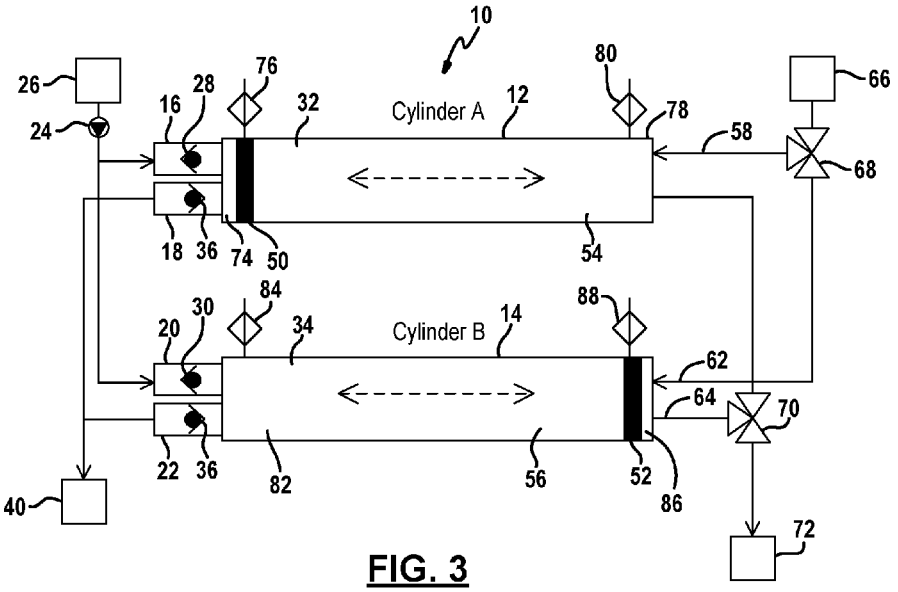
FIG. 3 Prior Art
FIG. 3 is a schematic view of the slurry injection system in a second state.
Figure 4:
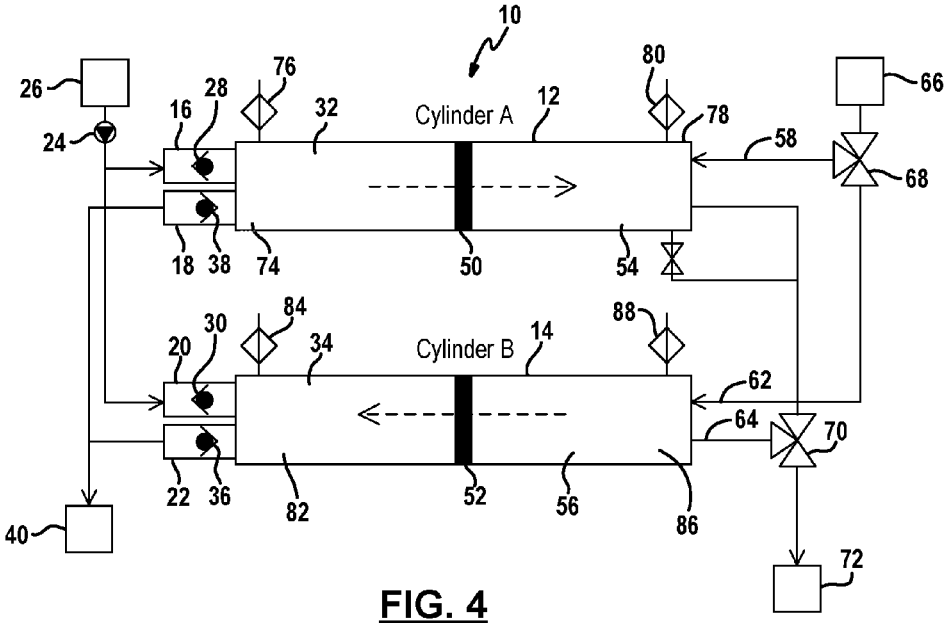
FIG. 4 Prior Art
FIG. 4 is a schematic view of the slurry injection system in a third state.
Figure 5:
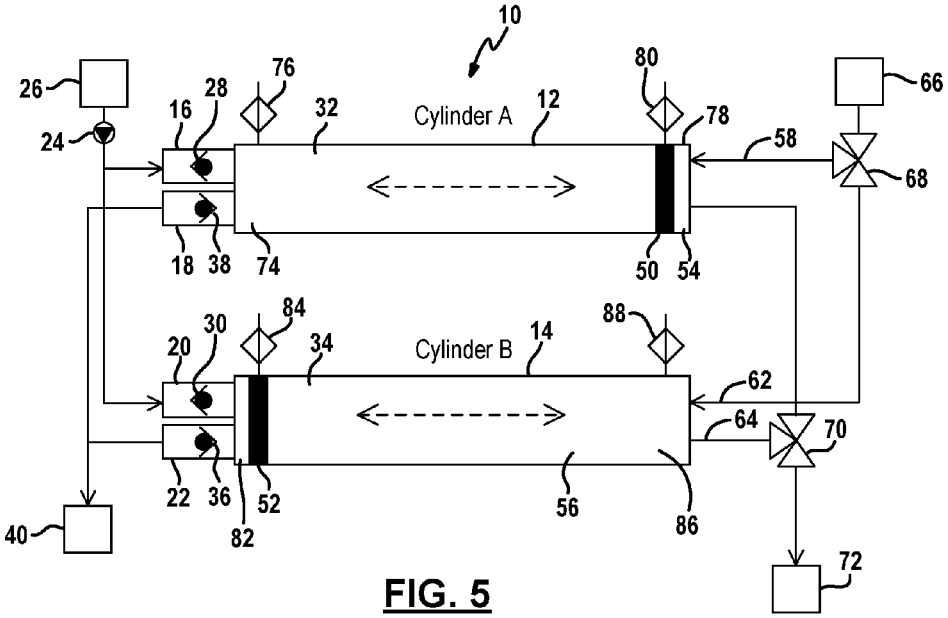
FIG. 5 Prior Art
FIG. 5 is schematic view of the slurry injection system in a fourth state.

The following description is merely exemplary in nature and is not intended to limit the present disclosure, application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

The following description is set forth with respect to a slurry injection system. However, other types of process fluids may be injected into a process using a drive fluid according to the teachings of the disclosure.

Figure 7:
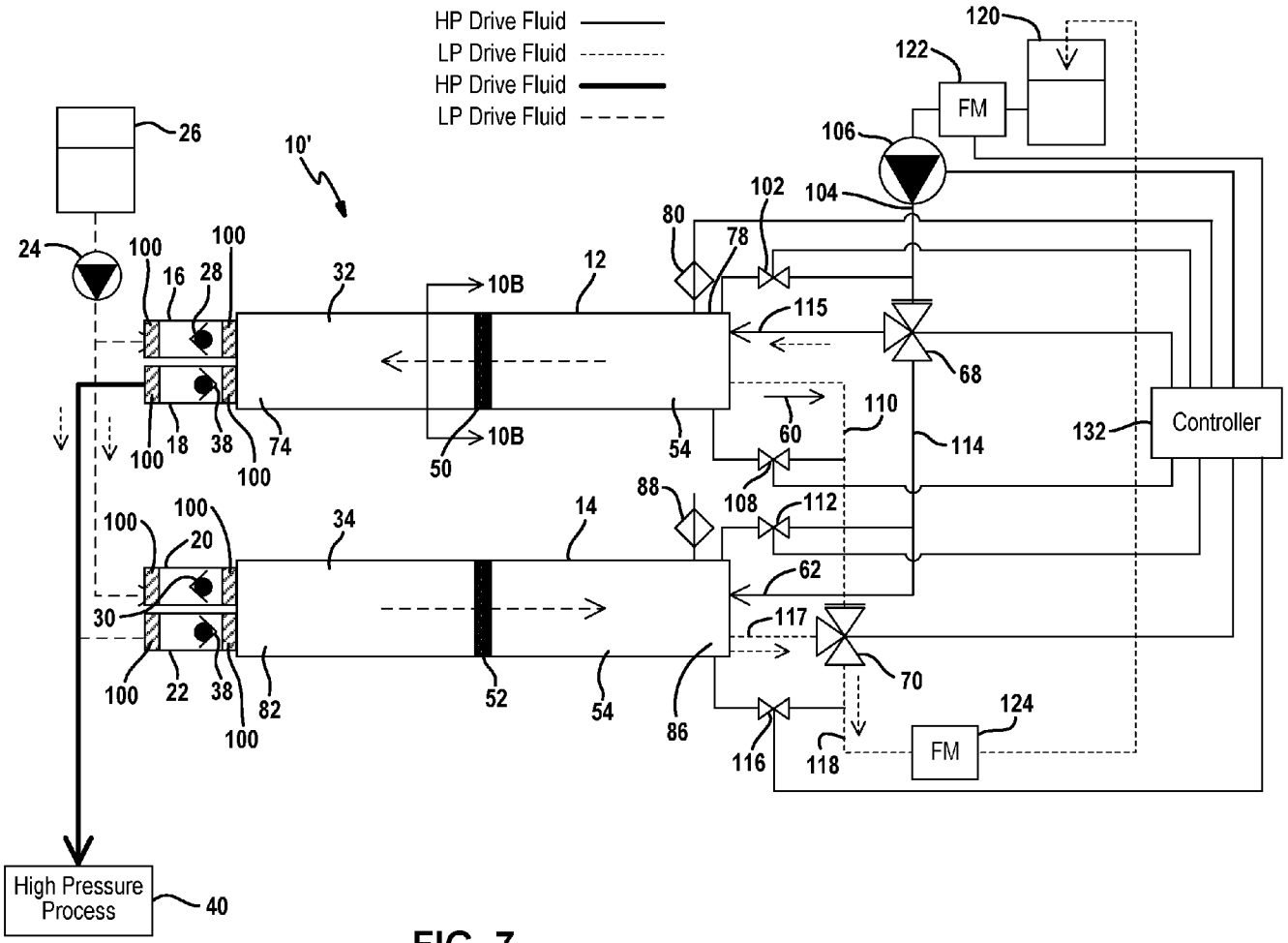
FIG. 7 is a schematic view of a slurry injection system according to the present disclosure.

Referring now to FIG. 7, an improved process fluid injection system 10' is set forth. There are many similarities to the system set forth in FIG. 1. Therefore, the same reference numerals are used to identify the same components. In this example, the check valves 28, 30, 36 and 38 are coupled to the respective first fluid cylinder 12 and the second fluid cylinder 14 using a union joint 100. The union joint 100 may be installed using a hammer, making the field replacement of the check valves 28, 30, 36 and 38 fast and easy. The system of FIG. 10' also includes a first bypass valve 102 fluidically coupled between the first fluid cylinder 12 and the piping 104 disposed between a pump 106 and the three-way valve 68. A second bypass valve 108 is fluidically coupled between the first fluid cylinder 12 and, in particular, the drive portion 54 and the piping 110 coupled between the drive outlet port 60 and the three-way valve 70. Another bypass valve 112 is coupled between the drive portion 56 of the second fluid cylinder 14 and the piping 114 between the three-way valve 68 and the drive fluid inlet port 62. A bypass valve 116 is in fluid communication between the drive outlet port 64 and the piping 118 between the check valve 70 and a low pressure tank.

In this example, the low pressure tank 120 and pump 106 and 170 have replaced the high pressure fluid reservoir and the low pressure reservoir 72 of FIGS. 1-5. This allows the drive fluid to be recirculated to the low pressure tank 120. A first flow meter 122 may be disposed between the first low pressure tank 120 and the pump 106. A second flow meter 124 may be disposed between the three-way valve 70 and the low pressure tank 120. The difference in the amount of flow into and out of the tank 120 may thus be measured.

In the prior system, position sensors were used to sense the location of the pistons and to generate a command to control the three-way valves. The flow meter 122 measures the amount of high pressure drive fluid entering the fluid cylinder 12 from a time when the three-way valve 68 opens. When a preset amount of flow is reached, which may correspond to a volume slightly less than the cylinder, a state change is commanded for both the three-way valves 68 and 70. The flow meter 124 may be used to measure the amount of drive fluid leaving the cylinders 12, 14. If there is a difference between the amount of flow that enters the cylinder and that which leaves the other cylinder, then the piston may not be returning to the expected position. The amount of flow into or out of a cylinder may be adjusted until flow equalization is obtained, based on a measurement of the two flow meters.

A controller 132 may be in electrical communication with the flow meter 122, the valve 102, the pump 106, the three-way valve 68, the valve 108, the valve 112, the valve 116, the three-way valve 70 and the flow meter 124. The controller 132 is also in fluid communication with the proximity sensors 80, 88. The flow meters and the proximity sensors are used to perform the same function, and thus, either the flow meters or the proximity sensors may be used to generate a signal that corresponds to the proximity of the first piston relative to the first drive fluid inlet port and/or the first drive fluid outlet port, and a second proximity of the second piston relative to the second drive fluid inlet port or the second drive fluid outlet port. The controller 132 monitors the movement of the piston by either the proximity signal or by the flow meter signals. When one of the pistons is proximate to the drive fluid end, this indicates to the controller that the three-way valve must be switched so that the piston can move in the opposite direction. In response to the piston being proximate to the drive fluid end of the cylinder, the three-way valves are switched to a dead zone state. For the first piston, either valve 102 or 108 are slowly and controllably opened to equalize the pressure between the drive portion and the associate piping. If the fluid cylinder 14 is proximate the drive end, the three-way valve 70 is placed into a second dead zone state while either valve 112 or 116 are controllably and slowly opened to equalize the pressure between the drive portion and the piping 114 or the piping 118, respectively.

Figure 8:
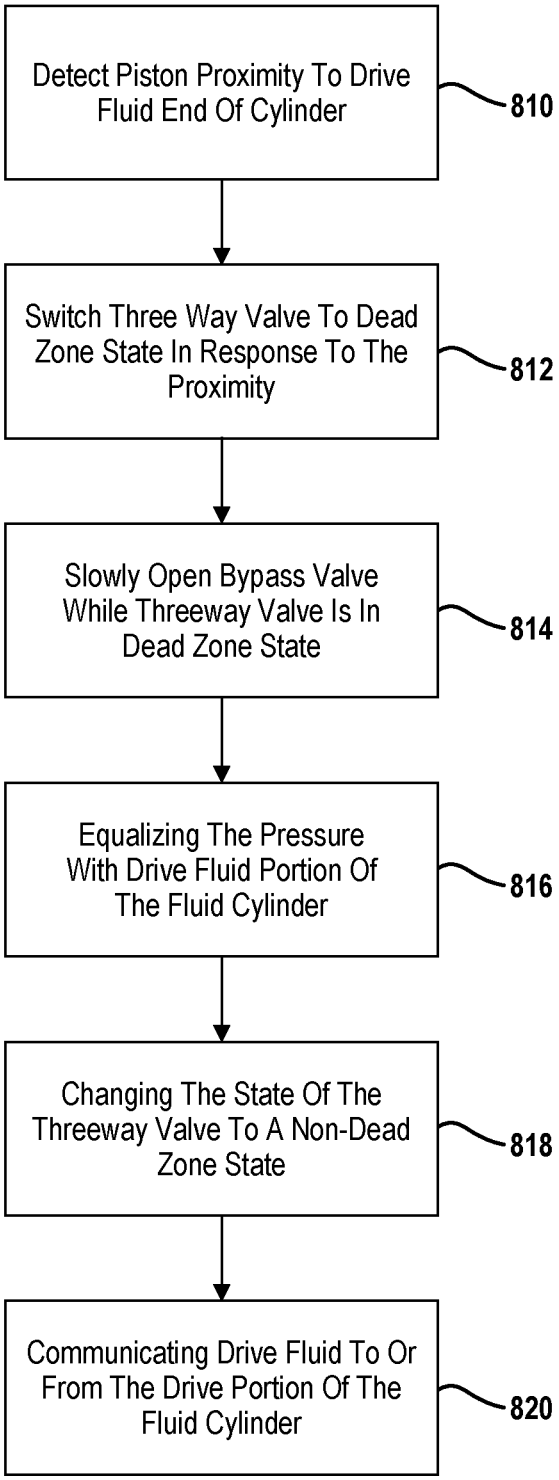
FIG. 8 is a flowchart of a method for operating the system of FIG. 7.

Referring now to FIG. 8, a method of operating the system of FIG. 7 is set forth. The method set forth in FIG. 8 describes a system that allows the pressure to equalize between the drive portion of the fluid cylinder and the piping feeding or removing drive fluid from the drive portion of the fluid cylinder. By relieving the pressure, the differential pressure during switching of the three-way valve is reduced, thereby reducing wear on the valves and the associated components.

In step 810, the piston proximity to the drive fluid end of the cylinder is detected. As mentioned above, the proximity of the drive fluid to the end of the cylinder may be determined by a proximity sensor signal, or by determining the flow of fluid into, out of, or both, of each of the drive fluid cylinders. In step 812, a three-way valve is switched to a dead zone state in response to the proximity signal indicating the end of the cylinder has been reached. In step 814, a bypass valve is slowly opened while the three-way valve is in a dead zone state. The bypass valves are illustrated in FIG. 8 as 102, 108, 112, and 116. The valves are opened prior to switching the valves to allow drive fluid into or out of the drive fluid portion of the fluid cylinder. For example, valves 102 and 112 are actuated or slowly opened prior to admitting drive fluid to the drive fluid portions. Valves 108 and 116 are actuated prior to releasing drive fluid from the drive fluid portion of the fluid cylinders. In step 818, the pressure within the drive portion of the fluid cylinder is equalized with the piping associated with the other end of each of the respective valves. This is performed in a "slow" manner. That is, the valves may be slowly opened within one second, rather than rapidly changing state. As mentioned above, this reduces the amount of stress on the various components within the system.

In step 818, the state of the three-way valves is changed to a non-dead zone state. That is, fluid is then communicated to or from the three-way valve in step 820.

The system uses two fluid cylinders 12, 14 that operate directly opposite to each other. That is, as one fluid cylinder is filling with drive fluid, the other fluid cylinder is removing drive fluid. In operation, the first fluid cylinder is receiving fluid from the drive fluid source while the second fluid cylinder is removing drive fluid and communicating the drive fluid to the drive fluid reservoir. When the proximity sensor is reached at the first fluid cylinder, both three-way valves are placed in a non-fluid communicating state. Pressure is relieved using the bypass valve. For example, the bypass valve 108 opens and bypass valve 112 opens. By opening bypass valve 108, the drive fluid is equalized to the fluid in the outgoing piping 110, so that when the bypass valve 70 communicates fluid to the fluid reservoir from the first fluid cylinder 12, the pressure is slowly equalized. Likewise, the bypass valve 112 is slowly opened so that the fluid cylinder is exposed to the pressure in the incoming piping 114. After the second fluid cylinder 14 reaches the proximity sensor 88, the opposite takes place. That is, the valves 102 and 116 are opened to expose the respective cylinders to the pressure in the piping 104 and 118.

Figure 9C:
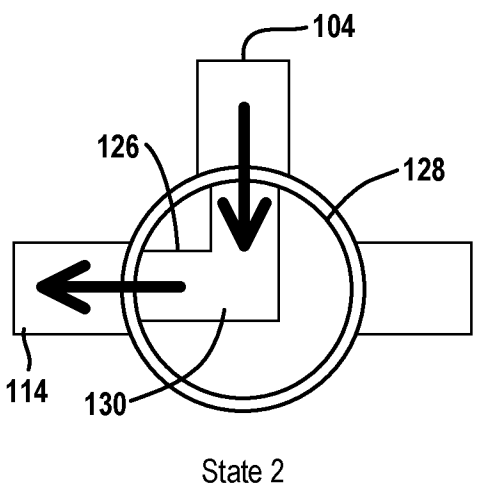
FIGS. 9A-9C are schematic representations of a three-way valve according to the present disclosure.
Figure 9B:
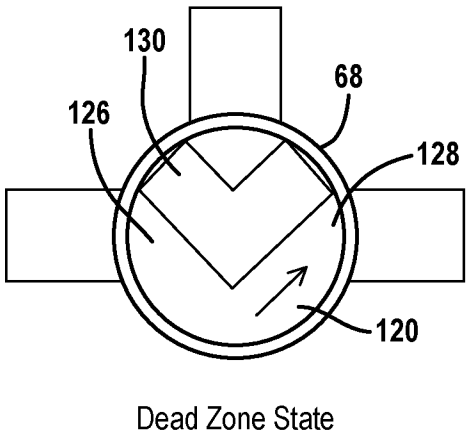
Figure 9A:
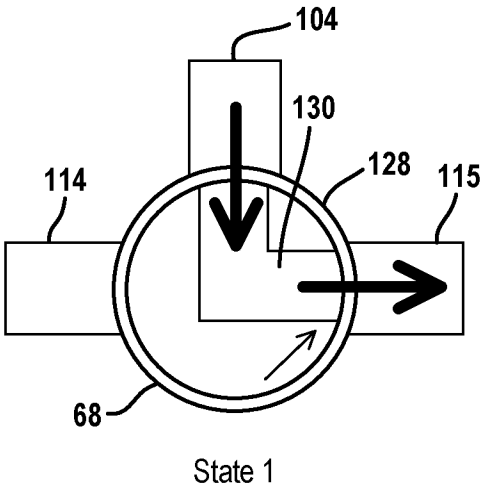

Referring now to FIG. 9A, a modified three-way valve used in FIG. 8A is set forth. In FIG. 9A, the three-way valve 68 has been modified to include the dead zone states mentioned above. The three-way valve 70 may operate and be configured in the exact same manner. The three-way valve 68 is illustrated in a first state communicating fluid from the low pressure tank 120 to the first fluid cylinder 12 through the piping 115. A port body 126 rotates in the valve body 128. In this example, the port body 126 has an L-shaped channel 130 therethrough. The L-shaped channel 130 allows only two different connections between the three inputs. As shown in FIG. 9B, an intermediate position of the port body 126 allows no connection between any of the three pipings 104, 114 and 115. This may be referred to as a dead zone.

In FIG. 9C, the L-shaped channel 130 communicates fluid from the piping 104 to the piping 114. This is in contrast to the first state shown in FIG. 9A that communicates fluid from the piping 104 to the piping 115.

Referring to FIG. 7 and FIGS. 9A-9C, the valves 102, 108, 112 and 116 are used in conjunction with the three-way valve 9A-9C during operation. Each time valve 68 is operated, either valve 102 or 108 are briefly opened. That is, when the piston 50 is at the proximity switch 80, the three-way valve 68 is moved to the dead zone as illustrated in FIG. 9B. The valve 102 is opened to gradually pressurize the cylinder 12 to match the pressure in the piping 114. For a typical size cylinder with 6,000 psi, about 200 cubic inches of water needs to pass through the valve 102 based on the compressibility of water. A desirable duration for pressurization may be about 1 second. Three-way valve 68 is then adjusted to connect cylinder 12 to the high pressure piping 114. When piston 12 reaches the end of its stroke, the three-way valve 68 is first put into a dead zone position as illustrated in FIG. 9B, then valve 108 is open for about 1 second (or another desired duration) draining the flow to the piping 110. The three-way valve is further adjusted to connect to fluid cylinder 14. The three-way valve 70 may be operated in a similar manner relative to the valves 112 and 116. By operating the valves in this manner, the very rapid changes present in FIGS. 1-5 described in the Background is eliminated. In many applications, such as hydraulic fracturing, the change differential may be between 9,000 psi and 30 psi in a fraction of a second, which may cause wear on the valves and other system components.

Figure 10A:
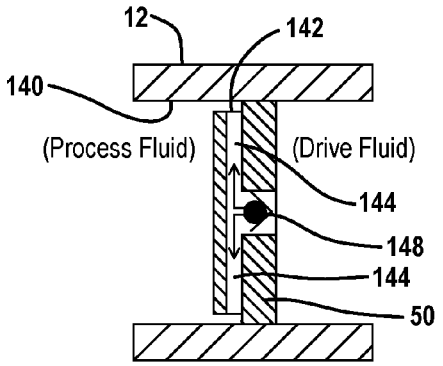
FIG. 10A is a side view of a piston according to the present disclosure.
Figure 10B:
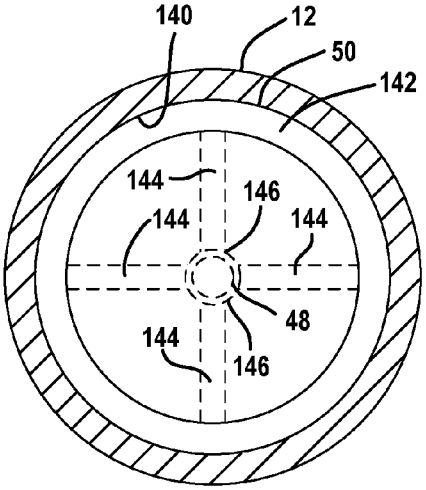
FIG. 10B is a front view of a piston according to the present disclosure.

Referring now to FIGS. 10A and 10B, the piston 50 disposed within the fluid cylinder 12 is illustrated in further detail. The piston 50 may be equipped with a means for carrying slurry or process fluid away from the piston 50 and the adjacent interior of the cylinder wall 140. The piston 50 may include a circumferential channel 142 that receives dry fluid through radially extending channels 144. In the present example, four radially extending channels 144 are set forth. Of course, different numbers of channels may be incorporated into the system. The radially extending channels 144 are in fluid communication with the drive portion 54 of the first cylinder 12. A check valve 148 is disposed within the piston port 146 to selectively communicate drive fluid through the piston port 146. The drive fluid communicated through the piston port 146 and to the circumferential channel 142 is cleaner than the slurry or process fluid, and thus the process fluid or slurry is removed from the circumferential channel 142 and away from the interior of the cylinder wall 140 to reduce wear at the piston 50. As the piston 50 moves toward the first process fluid end 74 of the fluid cylinder 12, the higher pressure forces the check valve to open so that clean drive pressure flushes the circumferential channel 142.

The example set forth in FIGS. 10A and 10B apply equally to the piston 52 within the fluid cylinder 14. Thus, one or preferably both of the pistons are configured in the manner set forth as described in FIGS. 10A and 10B.

Figure 11:
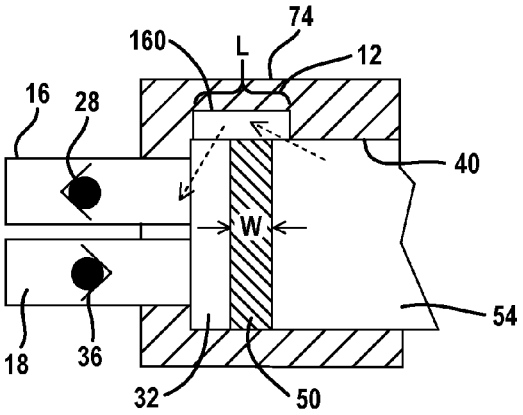
FIG. 11 is a side view of an axial groove relative to a fluid cylinder.

Referring now to FIG. 11, a method to prevent the piston 50 from crashing against the first end 74 of the fluid cylinder 12 is set forth. In this example, an axial groove 160 is disposed within the cylinder wall 140. The axial groove 160 allows drive fluid to be communicated from the drive portion 54 to the process portion 32. In the present example, the process portion 32 may be a slurry portion. The length L of the axial groove 160 is longer than the width W of the piston 50. Thus, when the piston 50 is adjacent to the axial groove 160, drive fluid is communicated from the drive portion 54 to the process portion 32. Further, the flow of drive fluid may be ceased when the piston is aligned with the axial groove 160. However, to clean the check valve 36, drive fluid may be communicated through the port 18. Of course, the piston 50 may include the circumferential channel 142, radial channel 144, check valve 14 and port 146.

Figure 12:
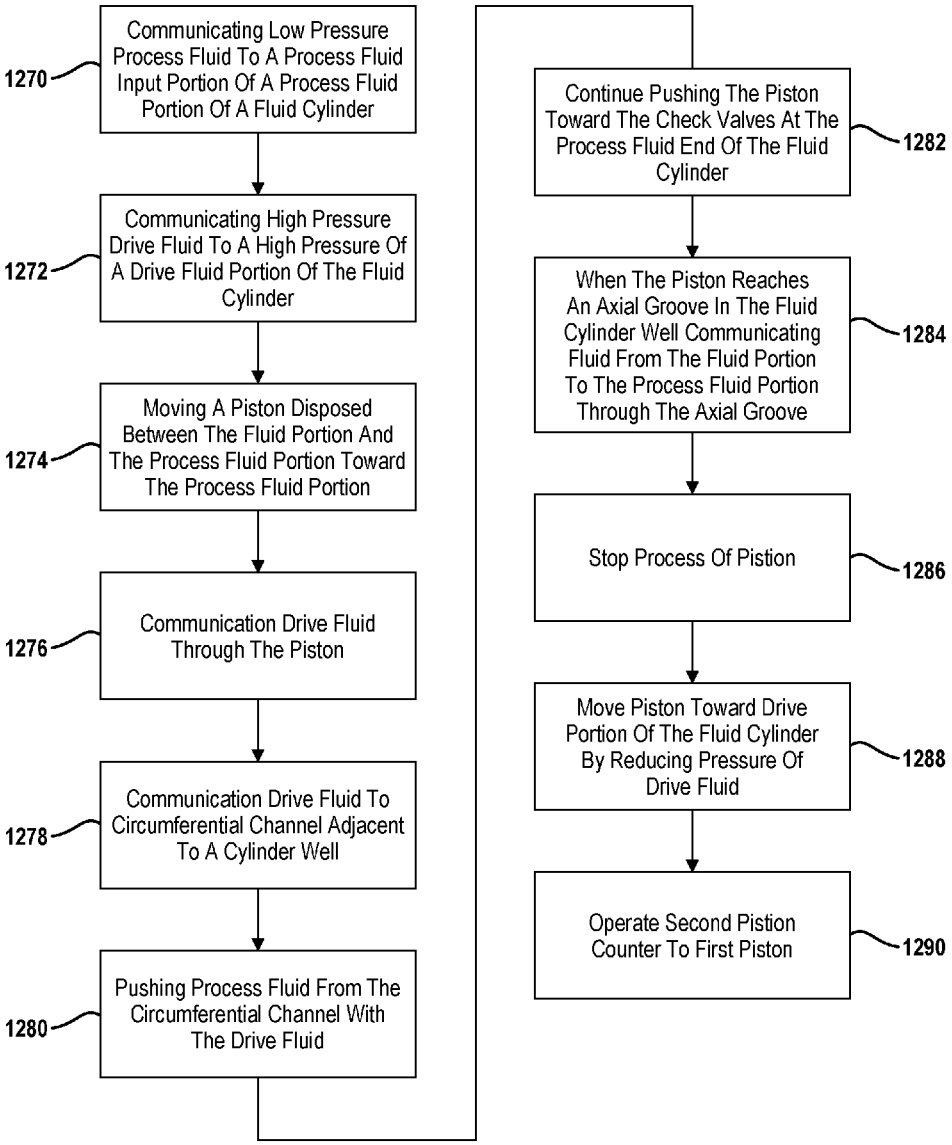
FIG. 12 is a flow chart of a method for operating the system of FIG. 8.

Referring now to FIG. 12, a method of operating the system is set forth. In step 1270, the low pressure process fluid, such as slurry, is communicated to a process fluid inlet port of a process fluid portion of a fluid cylinder. In step 1272, high pressure drive fluid is communicated to a high pressure port of a fluid portion of the fluid cylinder. In step 1274, a piston disposed between the drive fluid portion and the drive portion is moved toward the slurry portion. In step 1276, drive fluid is communicated through the piston. In step 1278, drive fluid is communicated to a circumferential channel adjacent to a cylinder wall. In step 1280, slurry or other process fluid is pushed from the circumferential channel with the drive fluid. In step 1282, the drive fluid continues to push the check valve open. In step 1284, when the piston reaches the axial groove in the fluid cylinder wall, fluid is communicated from the fluid portion to the slurry portion through the axial groove. In step 1286, the progress of the piston toward the check valves is stopped. In step 1288, the drive fluid pressure is reduced and the piston is retracted toward the drive portion of the fluid cylinder. In step 1290, the system as illustrated in FIGS. 1-7 operates with two cylinders counter to each other. That is, the pistons within each fluid cylinder are operating opposite to each other. That is, when one piston is moving in the process direction, the other piston is moving in the drive fluid direction.

Figure 13:
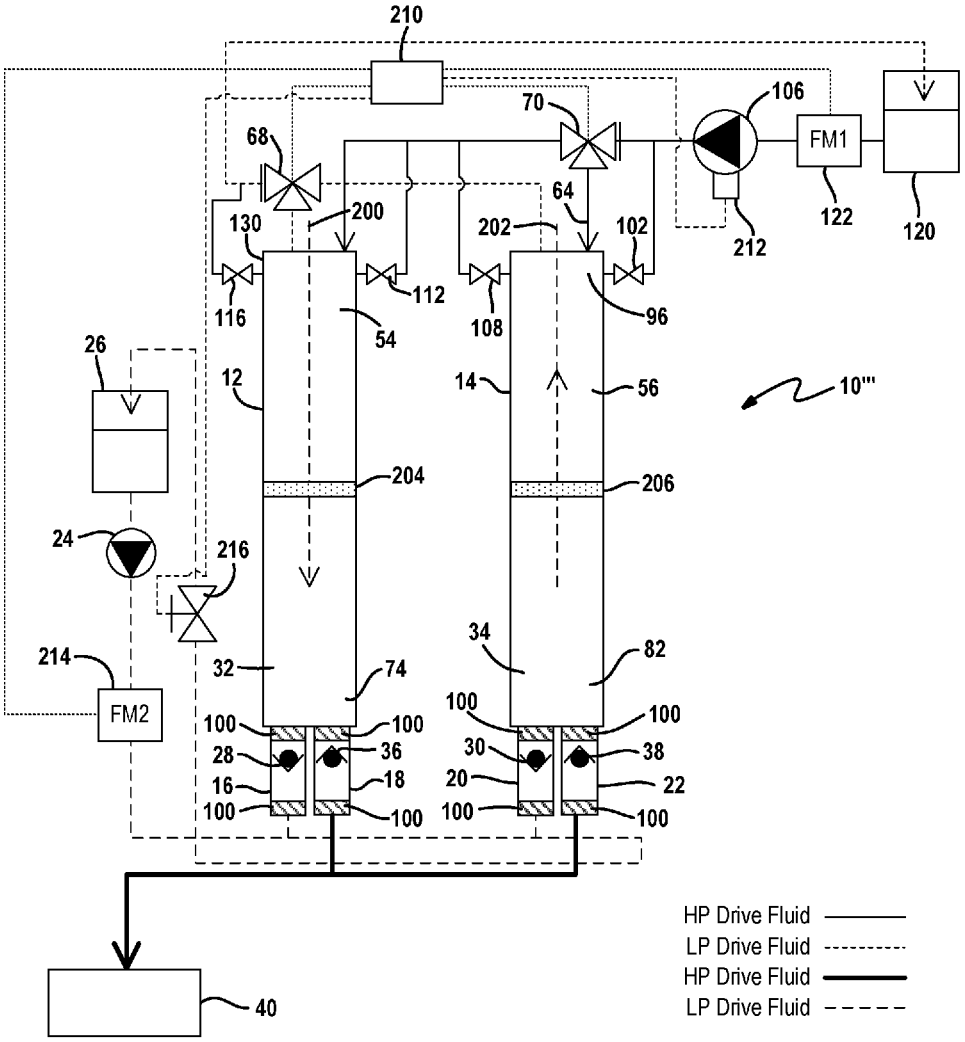
FIG. 13 is a schematic view of a slurry injection system having vertically oriented fluid cylinders.

Referring now to FIG. 13, the previous example set forth in FIGS. 1-11 have the longitudinal axes of the fluid cylinders oriented horizontally. In the example of the slurry injection system 10''' set forth in FIG. 13, a longitudinal axis 200, 202 of each of the fluid cylinders 12, 14 respectively, are illustrated in a vertical orientation. In this example, the heavy abrasive slurry or process fluid tends toward the check valves due to gravity. This minimizes wear and, when the drive fluid has a lower density than the process fluid, enables the pistons 50, 52 to be eliminated. In this example, a first fluid interface 204 is disposed within the first fluid cylinder 12. A second fluid interface 206 is disposed within the second fluid cylinder 14. The fluid interfaces 204, 206 form naturally due to the differences in the density of the drive fluid and the process fluid.

A controller 210, such as a programmable logic controller or another type of control unit, may be used to control the actuation of the three-way valves 68, 70. The actuation of the three-way valves 68, 70 may be performed in response to signals from one or more flow meters. Because the pistons have been eliminated, precisely monitoring the position of the pistons within the cylinders as performed above is not required. For example, if the fluid interface moves beyond the cylinder volume, such as into the piping below the check valves, no damage occurs to the system. In this example, an RPM counter 212 may be used to communicate the amount of fluid to the controller 210. This may eliminate the need for the flow meter 122. A second flow meter 214 measures the flow of slurry or process fluid into the cylinders. To maintain equal pumping of drive fluid and slurry, the controller 210 may be programmed to admit equal amounts of drive fluid and process fluid such as slurry. The flow meter 214 is in electrical communication with the controller 210.

The system 10''' may allow the system to be overpumped with drive fluid as described below. That is, more drive fluid may be pumped than process fluid, to allow the process fluid to be cleaned from the check valves. This will allow the check valves to open and close in relatively pure drive fluid. Because the fluid in the process fluid is diluted by overpumping the drive fluid, pump 24 may continuously circulate process fluid from the tank 26 to minimize the dilution of the slurry. A control valve 216 may regulate the flow of slurry and pressure in the circulation loop. The control valve 216 may also be in communication with the controller 210.

In this example, it is desirable to gradually flow the incoming and outgoing drive fluid and the incoming and outgoing process fluid to avoid interrupting the fluid interfaces 204, 206.

Referring now to FIG. 14, a chart illustrating the operating conditions of the example set forth in FIG. 13 is set forth. In the first row, check valves 28 and 38 are closed, while check valves 36 and 30 are open. The throttle valve 68 is communicating drive fluid to fluid cylinder 12 while throttle valve 70 is communicating drive fluid from the fluid cylinder 14. The flow meters have not reached the filling limits. In general, fluid cylinder 12 is pumping while cylinder 14 is filling.

The second row of FIG. 14 has each of the check valves 28, 30, 36, and 38 closed. The flow meter 122 indicates that the states must be changed because the end of the pumping cycle has been reached in fluid cylinder 12.

In the third row of FIG. 14, check valves 28 and 30 are opened, while check valves 36 and 38 are closed. Three-way valves are in the opposite state of row 1. That is, three-way valves 68 and 70 are such that fluid cylinder 12 is filling while fluid cylinder 14 is pumping.

In row 4 of FIG. 14, all of the check valves are closed and the flow meter 214 indicates a limit has been reached. This corresponds to the three-way valves 68 and 70 to change states.

Figure 15:
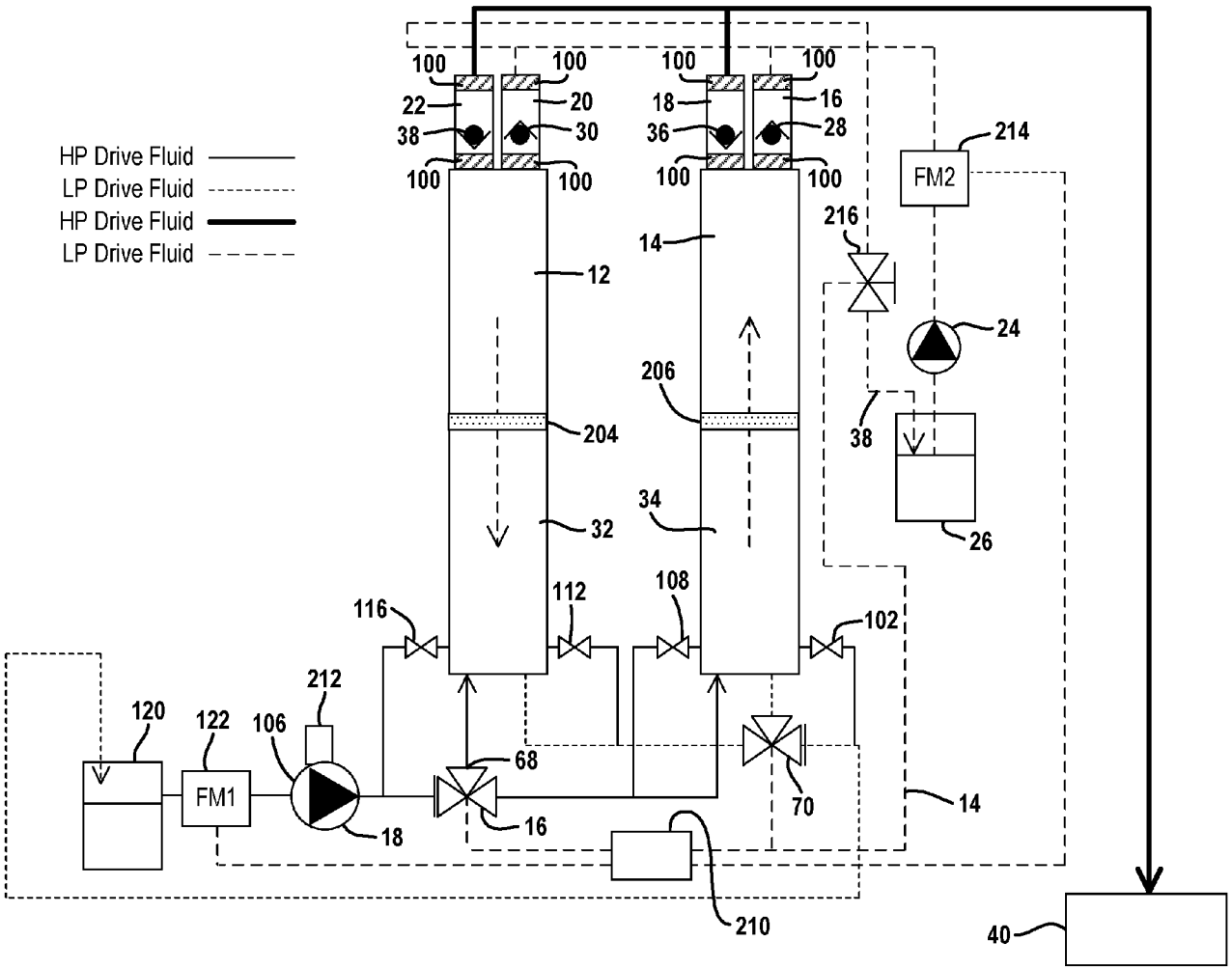
FIG. 15 is an alternative schematic of vertically oriented fluid cylinders in a system with less dense slurry.

Referring now to FIG. 15, the description of FIG. 13 described above is useful for the slurry or process fluid being more dense than the drive fluid. In FIG. 15, the drive fluid is less dense than the process fluid. The components are labelled the same as set forth in FIG. 13. The operation is identical except that the slurry is higher than the drive fluid within the cylinders 12, 14. Therefore, the operation of the same is not described.

Figure 16:
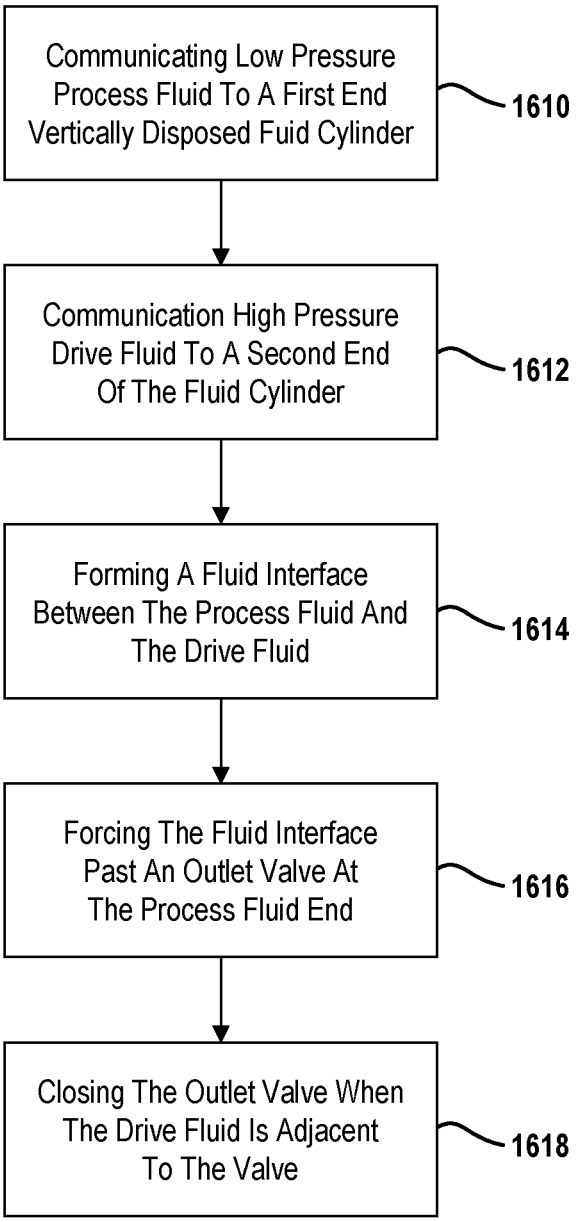
FIG. 16 is a flow chart of a method for operating the system of FIG. 13 or 15.

Referring now to FIG. 16, a method of operating the examples set forth in FIGS. 13 and 15 are set forth. In step 1610, low pressure process fluid is communicated to a vertically disposed fluid cylinder. The low pressure process fluid is communicated to a first end. In FIG. 13, the first end is the lower end of the vertical fluid cylinder, while in FIG. 15, the first end corresponds to the upper end.

In step 1612, the high pressure drive fluid is communicated to a second end of the cylinder. In FIG. 13, the second end is the upper end, while in FIG. 15, the second end is the lower end.

In step 1614, a fluid interface is formed between the slurry or process fluid and the drive fluid. The fluids may be slowly added to prevent mixing, and to encourage the formation of the fluid interface. As will be described below, smooth inlet surfaces may be used to prevent the inlet flow from mixing.

In step 1616, the fluid interface is forced to move by increasing the amount of drive fluid, and therefore the pressure, in the cylinder. In an overpumping condition, the fluid interface is forced past the outlet check valve at the process fluid end so that when the check valve is closed, the check valve operates within the relatively clean drive fluid.

In step 1618, the outlet valve or check valve is closed when the drive fluid is adjacent to the check valve. That is, the fluid interface is downstream of the check valve. This allows longer operation of the check valves.

Figure 17A:
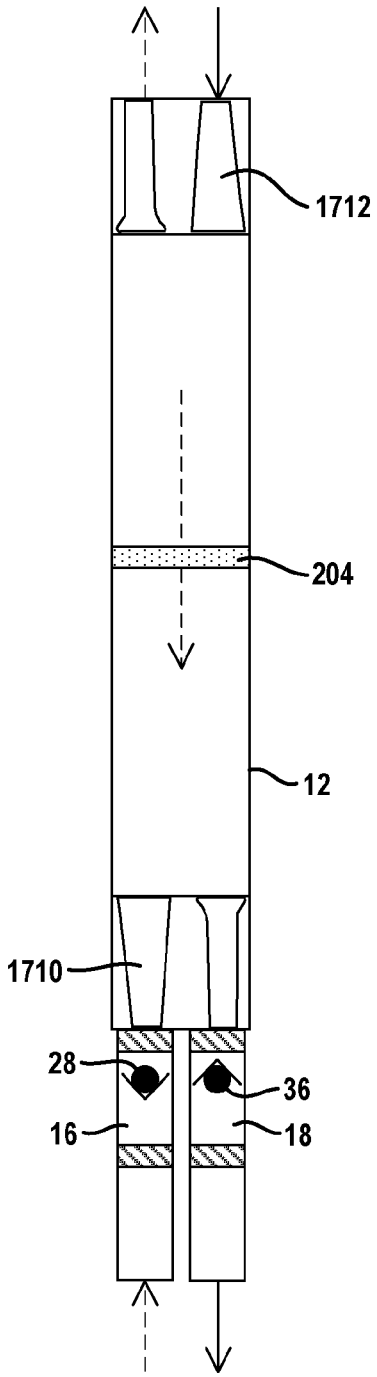
FIG. 17A is a cylinder having smoothly tapered passages as driving fluid and process fluid inputs.
Figure 17B:
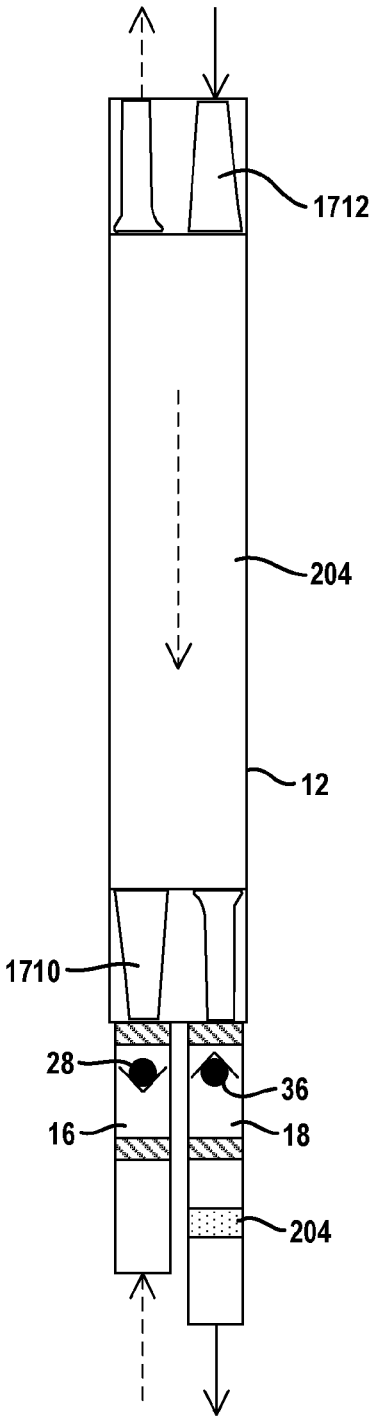
FIG. 17B is a representation of a fluid interface beyond the outlet check valve.

Referring now to FIGS. 17A and 17B, fluid cylinder 12 is illustrated having a smooth, tapered passage 1710. The smooth tapered passage 1710 is used to admit the process fluid into the fluid cylinder 12. Likewise, a smooth tapered passage 1712 is used to admit drive fluid into the fluid cylinder 12. By providing smooth passages for both the drive fluid and the process fluid, the fluid interface 204 may be maintained. Of course, smooth tapered passages may also be incorporated into the inlet passages of the fluid cylinder 14.

Referring now to FIG. 17B, the overpumping configuration described in reference to FIG. 16 is set forth. In this condition, the fluid interface 204 extends into the piping associated with the port 18 which removes the process fluid or slurry from the system. In this example, the check valve 36 is allowed to close within the drive fluid environment, which is relatively cleaner than the process fluid. By monitoring the flow meters, the amount of flow is known and therefore, the fluid interface 204 may only pass slightly past the check valve 36 in operation.

Figure 18:
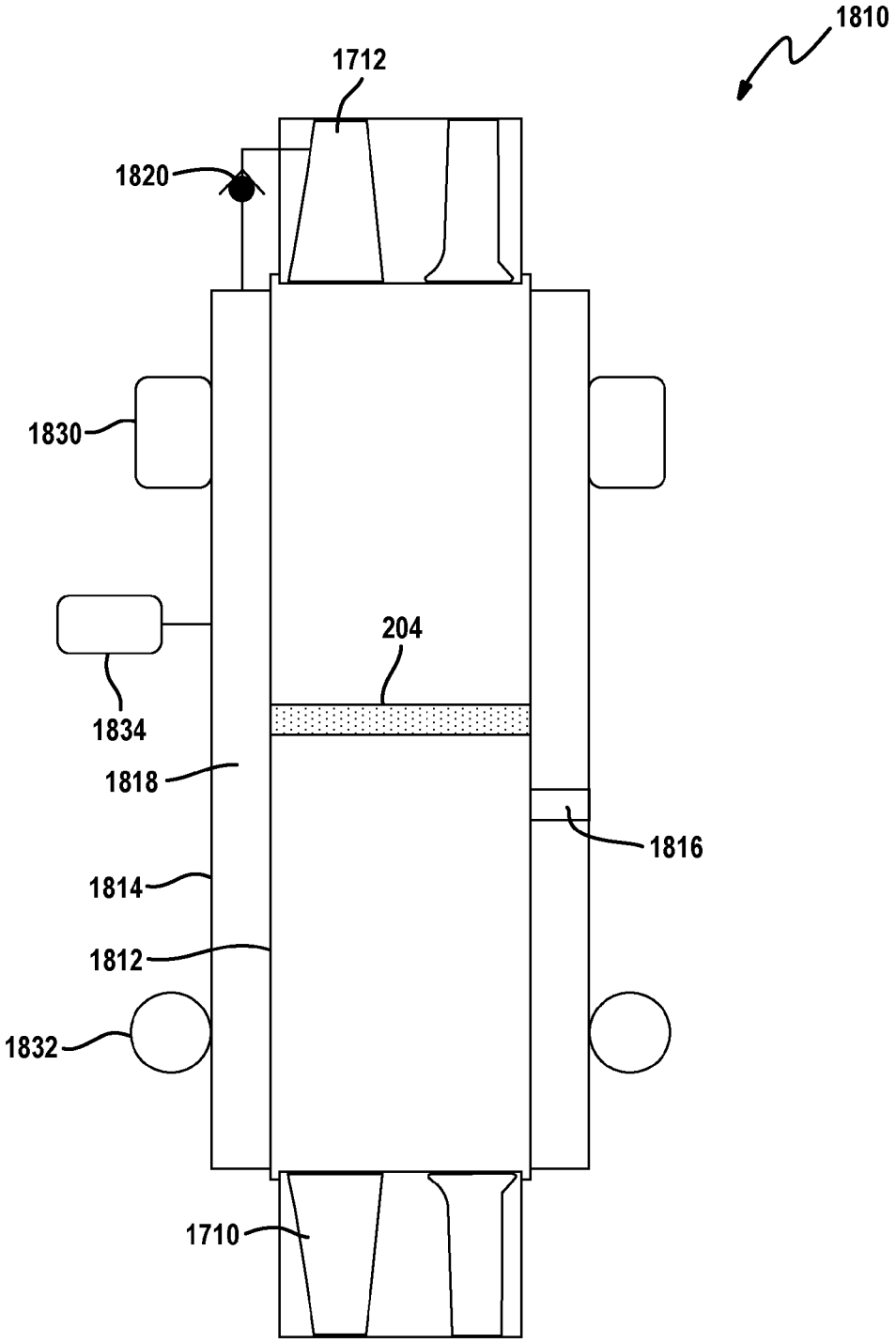
FIG. 18 is an alternative view of a fluid cylinder under constant compression to reduce stresses in the fluid cylinder.

Referring now to FIG. 18, because fluid cylinders are exposed to cyclical pressures that may range from 20 psig to well over 5,000 psig, tensile stresses may allow cracks in the cylinder walls. The axial length of the cylinder described above may actually grow and shrink in response to the internal pressures. The cyclical change forms stresses in the cylinders described above.

In FIG. 18, a fluid cylinder system 1810 is illustrated having an inner cylinder 1812 and an outer cylinder 1814. One or more spacers 1816 are disposed between the inner cylinder 1812 and the outer cylinder 1814 so that an annular space 1818 is maintained between the inner cylinder 1812 and the outer cylinder 1814. The annular space 1818 may be relatively small. In one constructed example, the annular space was 0.1 inches. The annular space 1818 is in fluid communication with the drive fluid so that the annular space has the highest pressure experienced within the inner cylinder 1812. A check valve 1820 is disposed to allow one way flow of drive fluid into the annular space 1818. Thus, the annular space 1818 has the highest pressure experienced by the drive fluid. Because of this, the annular space and thus the inner fluid cylinder 1812, is always under a compressive load. That is, the pressure within the annular space 1818 forces the fluid cylinder 1812 to be under a compressive load. Because of the compressive load, the expansion and contraction of the fluid cylinder will not occur, and thus the life of the cylinder may be indefinite. To allow the outer cylinder to be mounted, a fixed mount 1830 is used to fixedly mount the outer cylinder 1814 to a fixed structure. A roller structure 1832 disposed a distance away from the fixed mount is used to rotatably couple the outer cylinder 1814 to a structure. The roller structure 1832 allows the outer cylinder 1814 to expand and contract while the rollers allow for axial expansion of the system 1810.

An accumulator 1834 may be incorporated into the system and may be fluidically coupled to the annular space 1818. The accumulator 1834 helps insure proper functioning of the check valve 1820 by allowing some flow into the annular space.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A system comprising:

a first fluid cylinder having a first process fluid end and a first drive fluid end, said first cylinder comprising a first process fluid inlet port and a first process fluid outlet port disposed at the first process fluid end of the first fluid cylinder and first drive fluid inlet port and a first drive fluid outlet port disposed at the first drive fluid end of the first fluid cylinder, said first fluid cylinder oriented vertically;

a first liquid fluid interface disposed between the first process fluid end and the first drive fluid end to divide the first fluid cylinder into a first process fluid portion and a first drive fluid portion;

a first pump pumping drive fluid to the drive fluid portion to drive the fluid interface to pressurize the process fluid, said first pump pumping the first liquid fluid interface beyond a first valve disposed within the first process fluid outlet port; and said first valve closing within the drive fluid.

2. The system as recited in claim 1 wherein the first valve comprises a check valve.

3. The system as recited in claim 1 further comprising a second fluid cylinder having a second process fluid end and a second drive fluid end, said second fluid cylinder comprising a second process fluid inlet port and a second process fluid outlet port disposed at the second process fluid end of the second fluid cylinder and second fluid inlet port and a second fluid outlet port disposed at the second fluid end of the cylinder, said second fluid cylinder oriented vertically; and a second liquid fluid interface disposed between the second process fluid end and the second drive fluid end to divide the second fluid cylinder into a second process fluid portion and a second drive fluid portion;

said first pump pumping drive fluid to the second drive fluid portion to drive the second fluid liquid interface beyond the second process fluid outlet port; and a second valve disposed within the second process fluid outlet port closing within the drive fluid.

4. The system as recited in claim 3 wherein the second valve comprises a check valve.

5. The system as recited in claim 1 wherein the first process fluid end comprises a first slurry end.

6. A method comprising;

communicating drive fluid into a drive fluid portion of a fluid cylinder having a first end and a second end, said fluid cylinder comprising a process fluid inlet port and a process fluid outlet port disposed at the first end and drive fluid inlet port and a drive fluid outlet port disposed at a second end of the cylinder;

moving a fluid interface to pressurize process fluid in response to communicating drive fluid to the drive portion;

forcing pressurized process fluid from a process fluid outlet port;

communicating the first liquid fluid interface past a valve in the process fluid outlet port; and closing the valve within the drive fluid.

7. The method as recited in claim 6 wherein communicating drive fluid past the valve comprises communicating drive fluid past a check valve.

* * * * *